US005724756A

United States Patent [19]

Gale

[11] Patent Number: 5,724,756

[45] Date of Patent: Mar. 10, 1998

[54] BUCKET TIP RETENTION MEANS

[75] Inventor: Preston L. Gale, Mackinaw, Ill.

[73] Assignee: Caterpillar Inc., Peoria, Ill.

[21] Appl. No.: 779,192

[22] Filed: Jan. 6, 1997

[51] Int. Cl.[6] ..... E02F 9/28

[52] U.S. Cl. ..... 37/458; 37/455; 37/456

[58] Field of Search ..... 37/450, 452, 453, 37/454, 455, 456, 457, 458, 459; 172/772, 772.5, 753, 713; 403/154, 329

[56] References Cited

U.S. PATENT DOCUMENTS

| | | | |
|---|---|---|---|
| 2,936,538 | 5/1960 | Opsahl | 37/458 |
| 2,951,300 | 9/1960 | Ratkowski | 37/457 |
| 3,106,256 | 10/1963 | McBride | 37/458 X |
| 4,187,035 | 2/1980 | Colburn | 37/458 X |
| 4,342,166 | 8/1982 | Johnson et al. | 37/458 |
| 4,602,445 | 7/1986 | Nilsson | 37/457 |
| 4,823,487 | 4/1989 | Robinson | 37/457 |
| 5,361,520 | 11/1994 | Robinson | 37/458 |
| 5,469,648 | 11/1995 | Jones et al. | 37/455 X |
| 5,491,915 | 2/1996 | Robinson | 37/455 X |

FOREIGN PATENT DOCUMENTS

| | | | |
|---|---|---|---|
| 799348 | 11/1968 | Canada | 37/458 |

*Primary Examiner*—Terry Lee Melius
*Assistant Examiner*—Thomas A. Beach
*Attorney, Agent, or Firm*—O. Gorden Pence

[57] ABSTRACT

Bucket tip retention means for retaining an excavator bucket tip to an adapter on an excavator bucket including a retention pin extending through co-axial bores in the bucket tip and the adapter, the retention pin having a groove defined in a front face, a positioning shoulder extending from the rear face of the pin, and a resilient locking clip element retained in the locking clip groove by a clip retaining pin, the locking clip element having a first locking portion and a second locking portion extending from the locking clip groove for engaging the bore in the adapter and urging the positioning shoulder to engage the bore in the adapter.

23 Claims, 1 Drawing Sheet

Fig. 1
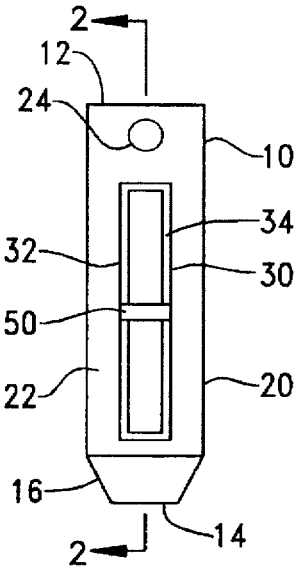
Fig. 2
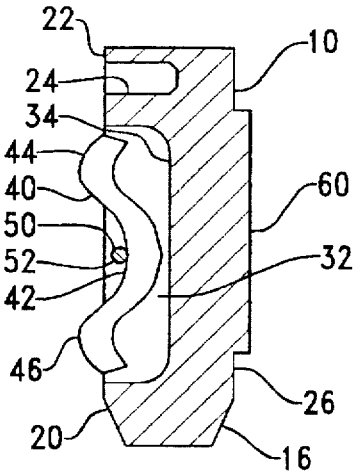
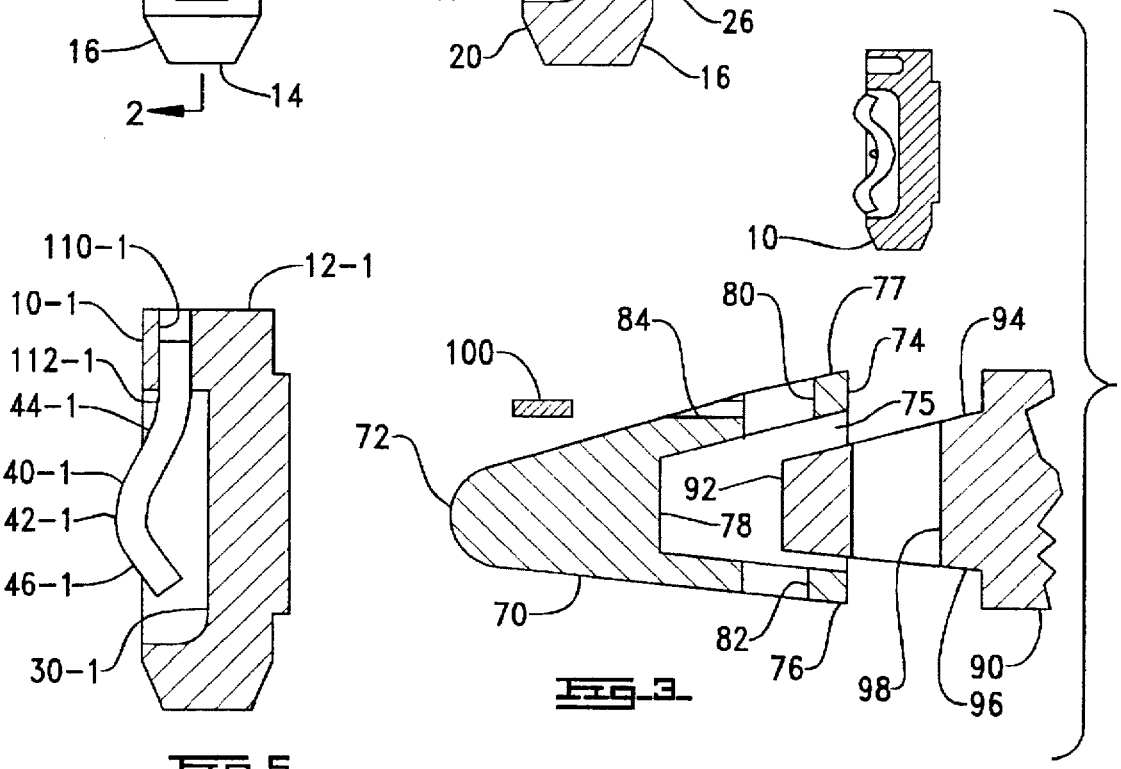
Fig. 3
Fig. 5
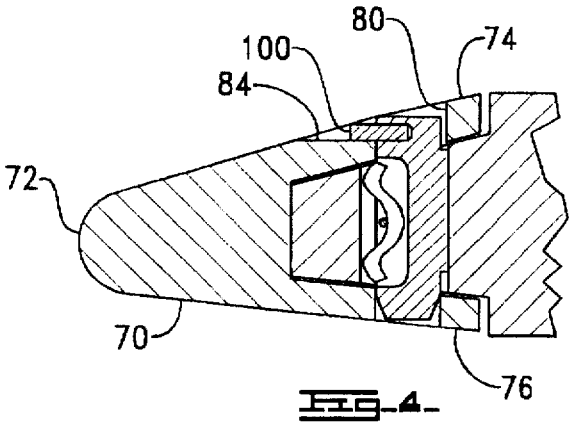
Fig. 4

BUCKET TIP RETENTION MEANS

TECHNICAL FIELD

This invention pertains generally to excavating equipment, and more particularly to means for retaining bucket tip teeth to an excavating apparatus.

BACKGROUND ART

Excavating apparatus is commonly equipped with a bucket which serves as a means for accepting and removing from one location to another a discreet quantity of material such as soil, rock, and gravel. The bucket is typically controllably and pivotally mounted on one or more arms which permits a freedom of motion in two or more axes and enables an operator to control the position of the bucket. This enables an operator of an excavator apparatus to position the bucket to engage, for example, the soil and to be driven into the soil to accept a quantity thereof and remove the same.

Experience has shown that the functionality of an excavator apparatus can be enhanced by providing one or preferably more teeth extending from the bucket in such a way as to engage and break loose the material as the bucket is driven into the material. Because of the varying characteristics of the materials upon which excavating apparatus is used, it is common to provide these bucket tips as tooth sub-assemblies. These tooth sub-assemblies typically are comprised of a plurality of teeth mounted upon an adapter means which may be selectively secured to the bucket of the excavator apparatus. This also enhances the longevity of the bucket of an excavator apparatus, in that the bucket tips are often subject to a high degree of stress and resultant breakage. Furthermore, of course, as the bucket tips are the primary material engaging elements, they are further subjected to a high degree of wear, which reduces the functionality of the bucket tips over time, necessitating their occasional replacement. It is obviously undesirable to replace the entire bucket tooth sub-assembly merely because of the breakage or excessive wear of one or more of the bucket tips, and therefore various attempts have been made to develop satisfactory means for retaining individual bucket tips on the tooth sub-assembly.

One of the more successful methods of assembling a bucket tip to the tooth sub-assembly has been to provide a bucket tip having a rearward facing opening designed to cooperatively accept a mounting nub protruding from the tooth sub-assembly adapter base. This mounting nub typically provides sufficient structural support to ensure that the bucket tip remains generally in the appropriate alignment with respect to the tooth sub-assembly. In order to retain the bucket tip on the tooth sub-assembly adapter base, openings are provided for accepting a securing means through the bucket tip and the mounting nub. Generally, it has been found unsatisfactory to use a bolt of common design, due to the fact that the shaft and nut thereon, when protruding from the bucket tip, are susceptible to wear and to damage and breakage, which permits the bucket tip to be released from the adapter base. Also, protruding bolts, shafts, and nuts and the like may undesirably impede the flow of material into and from the bucket, reducing the efficiency of the excavating apparatus.

In order to overcome these problems, it has been a more common practice to employ concealed retaining pins which are contained fully within the aligned openings of the bucket tip and mounting nub. Some problems have been encountered in the use of these concealed retaining pins, however.

One problem lies with the fact that during the course of normal operation, and under the effects of the normal wear and tear resulting therefrom, the retaining pin must not become so loose as to dislodge from the transverse openings in the mounting nub and bucket tip and permit the bucket tip to become unsecured. On the other hand, the retaining pin must admit of some relative movement between the bucket tip and the mounting nub so as to ensure that the greater proportion of the load on the bucket tip is transferred directly to the mounting nub and not carried through the retaining pin. Furthermore, of course, in the event that the bucket tip becomes undesirably worn or broken, the retaining pin must be sufficiently easy to remove so as to permit a replacement bucket tip to be installed.

Several various attempts have been made to fulfill these requirements, and have met with varying levels of success. One solution has been to provide a flexible pin comprised of a pin element with a spaced apart wedge member. An elastomeric member is disposed between the pin and wedge member to urge the wedge member away from the pin and ensure a compressive fit when disposed within the bucket tip and mounting nub opening. Because the installation of such a pin assembly requires considerable compression of the elastomeric member, it is not uncommon for the elastomeric member to become overstressed and to shear causing installation difficulties with this type of pin assembly. Another attempt to solve this problem has resulted in the use of a wedge shaped member to control the distance which the bucket tip can move with respect to the mounting nub. However, the use of such a wedge shaped pin or member is relatively disadvantageous in that the loads and stresses encountered by the bucket tip are then transferred through the wedge member to the mounting nub, resulting either in a breakage of the wedge member or conversely, requiring that the wedge member and mounting nub be substantially enlarged to carry those loads.

Therefore, it is an object of the subject invention to provide a simple and improved bucket tip retention system.

It is another object of the present invention to provide such a bucket tip retention system as will employ an improved retention pin.

It is yet another object of the present invention to provide such a bucket tip retention system as will employ a retention pin of relatively simple design.

It is another object of the present invention to provide such an improved bucket tip retention system as will include a retention pin not susceptible to unintentional dislodgement.

It is yet another object of the present invention to provide such an improved bucket tip retention system as will include an improved retention pin having a flex member which is not subject to ready shear or excessive compression.

It is yet a further object of the present invention to provide such an improved bucket tip retention system as will ensure proper seating of the bucket tip on the mounting nub of the adapter so as to cause the greater proportion of loads and stresses encountered by the bucket tip to be transferred directly to the mounting nub of the adapter.

It is yet a further object of the present invention to provide such an improved bucket tip retention system as will permit a ready, selective replacement of a broken or worn bucket tip.

It is yet another object of the present invention to provide such an improved bucket tip retention system as will be simply and easily manufactured.

These and other objectives of the present invention will become apparent in the specification and claims that follow.

SUMMARY OF THE INVENTION

The subject invention is a bucket tip retention system comprised of a bucket tip having a rearward facing opening for accepting a mounting nub of an adapter base, with aligned transverse apertures provided in the bucket tip, an adapter base having a forwardly directed mounting nub protruding therefrom for entering into and cooperatively engaging the opening of the bucket tip and a transverse aperture for alignment with the apertures of the bucket tip when the mounting nub is so engaged, and a retention pin having a resilient spring means for engaging the interior of the mounting nub transverse opening when engaged therein and further having stops protruding from the body of the pin oppositely disposed from the spring means, such that the spring means will engage the interior of the transverse aperture of the mounting nub to force the stops into engagement with the bucket tip and thus prevent unintentional dislodgement of the retention pin. In another embodiment, an additional shear pin is provided on an axis transverse to the axis of the retention pin to engage the bucket tip and the retention pin and further aid in preventing unintentional dislodgement of the retention pin.

BRIEF DESCRIPTION OF THE DRAWINGS

FIG. 1 discloses a frontal view of a retention pin according to the present invention.

FIG. 2 is a cross-sectional view of the retention pin as shown in FIG. 1 taken along section line 2—2.

FIG. 3 discloses the retention pin according to FIG. 1 in a typical bucket tip and adapter sub-assembly.

FIG. 4 shows the retention pin according to the present invention in a completed bucket tip and adapter sub-assembly.

FIG. 5 discloses an alternative embodiment of the retention pin according to the present invention.

DESCRIPTION OF THE PREFERRED EMBODIMENT

A retention pin for selectively securing a replaceable bucket tip and adapter for securing a plurality of bucket tips to an excavator bucket or the like is shown in FIG. 1 and referred to by the reference numeral 10.

The retention pin can have an upper end 12 and a lower end 14, both of which are typically planar and perpendicular to the axis of the pin 10. The lower end of the pin 10 further typically includes a frustoconical tapered portion 16 adjacent the lower pin end 14, which causes the body of the pin 10 to narrow as it approaches the lower pin end 14. Extending upward from the lower tapered portion 16 to the upper pin end 12 is the pin main body 20.

The pin main body 20 includes a front face 22. A shear pin bore 24 is provided into the front face 22 substantially adjacent to the upper pin end 12. An elongate locking clip groove 30 is disposed on the front face 22 between the shear pin bore 24 and the tapered portion 16.

The locking clip groove 30 is preferably defined by two spaced apart planar groove walls 32 extending into the main pin body 20 and joined at the base thereof by a locking clip groove floor 34. The locking clip groove 30 thus defined is generally parallel to the axis of the pin main body 20.

Disposed within the locking clip groove 30 is a locking clip element 40. The locking clip element 40 is preferably waveform in shape, such as a sinusoidal waveform, as can be seen more clearly in FIG. 2 which discloses a cross-sectional view of the retention pin 10 as taken along the section line 2—2 at FIG. 1. The locking clip 40 includes a depressed center portion 42 which is disposed in the locking clip groove 30 on the groove floor 34. The locking clip element 40 further includes an upper end having an upper, first locking portion 44 and a lower, second locking portion 46. The clip upper locking portion 44 and the clip lower locking portion 46 protrude from the locking clip groove 30 and extend from the pin front face 22. A clip retaining pin 50 is provided in a clip retaining pin bore 52 at substantially the center of and transverse to the locking clip groove 30. As can be seen in FIG. 2, the clip retaining pin bore 52 is spaced apart from the locking clip groove floor 34 a sufficient measure to permit a degree of flexible motion of the locking clip element 40 while simultaneously preventing the removal thereof from the locking clip groove 30. Preferably, the clip retaining pin 50 is retained in the clip retaining pin bore 52 by an interference fit therebetween.

The retention pin 10 further includes a pin rear face 26 opposite to the pin front face 22 on the pin main body 20. A positioning shoulder or ridge 60 protrudes from the pin rear face 26 opposite the locking clip groove 30. This positioning shoulder 60 extends longitudinally along the pin rear face 26.

Turning then to FIGS. 3 and 4, the retention pin 10 is seen in conjunction with a bucket tip or excavator tooth 70. The bucket tip 70 includes a ground engaging bucket tip nose 72 and an opposite mounting end 74. The mounting end 74 has a rearwardly opening cavity 75, which is defined in part by a rearwardly extending upper first tab 77, a rearwardly extending lower second tab 76 spaced apart from the first tab 77, and a cavity end surface 78. The bucket tip upper tab 77 extends at an upward angle, while the bucket tip lower tab 76 extends at a downward angle, with respect to the bucket tip nose 72, such that the bucket tip 70 is V-shaped to provide good ground penetration. The upper tab 77 is provided with a first tab bore 80 defined therethrough and the lower tab 76 is provided with a second tab bore 82 defined therethrough. The first tab bore 80 and the second tab bore 82 are coaxial and sized to receive in a non-interference fit the retention pin 10. Also provided in the upper tab 77 is a shear pin bore 84 which extends into the upper tab 77 and substantially perpendicularly intersects the upper tab bore 80.

The bucket tip adapter 90 can also be seen in FIGS. 3 and 4. The bucket tip adapter 90 includes an adapter nose 92 having an adapter nose upper surface 94 for engaging the bucket tip upper tab 77 and an adapter nose lower surface 96 for engaging the bucket tip lower tab 76. An adapter nose bore 98 is provided through the adapter nose 92 from the adapter nose upper surface 94 to adapter nose lower surface 96. The adapter nose bore 98 is coaxial with the bucket tip upper tab bore 80 and bucket tip lower tab bore 82 when the bucket tip 70 is disposed on the adapter nose 92. A shear pin 100 sized for interference fit with the shear pin bore 24 in the pin main body 20 is also provided.

Assembly of the retention pin 10, the bucket tip 70, and the bucket tip adapter 90 can also be readily seen in FIGS. 3 and 4. The bucket tip 70 is placed over the adapter nose 92 of the bucket tip adapter 90 so that the cavity end surface 78 contacts the adapter nose 92. This brings the adapter nose bore 98 into coaxial alignment with the upper tab bore 80 and the lower tab bore 82. The retention pin 10 is then inserted, with the lower pin end 14 first so that the lower tapered portion 16 serves to guide the pin main body 20 into the combined bores. As the retention pin 10 is urged further into the first tab bore 80, the lower locking portion 46 of the locking clip element 40 contacts the upper tab 77, causing the locking clip element 40 to pivot slightly about the clip retaining pin 50 and to be urged into the locking clip groove 30. As the retention pin 10 continues to be urged into the first tab bore 80, the pin main body 20 enters the adapter nose bore 98, and the upper locking portion 44 contacts the upper tab bore 80. The locking clip element 40, in response, attempts to pivot about the clip retaining pin 50, causing the lower locking portion 46 to be urged into contact with the adapter nose bore wall 98 and also causes the upper locking portion 44 of the locking clip element 40 to be urged resiliently into the locking clip groove 30, causing the center clip portion 44 to act on the locking clip groove floor 34 to urge the positioning shoulder 60 against the adapter nose bore 98. The shear pin 100 is then inserted through the upper tab shear pin bore 84 and into the shear pin bore 24 in the pin main body 20, where it is retained in an interference fit therebetween.

Those skilled in the art will recognize that the typical bucket is provided with a plurality of adapters 90, to permit affixing a plurality of bucket tips 70 thereto to complete a bucket tip sub-assembly for use on an excavator apparatus. The foregoing process may be repeated as required to affix each of the plurality of bucket tips 70 to the bucket tip adapter 90. The bucket tip adapters are then attached by conventional means to the excavator bucket upon which it is to be operated, as is well known to those skilled in the art.

The bucket tips 70 and bucket tip adapter 90 are typically formed of steel, such as forged or alloyed steel. Similarly, it is preferable to form the pin main body 20 and the clip retaining pin 50 from a durable alloyed steel material. The locking clip element 40 is preferably a formed steel having a high spring constant so that it is unlikely to become deformed permanently when compressed in the assembly of the bucket tip 70, bucket tip adapter 90, and the retention pin 10. Also, the locking clip element 40 must be sufficiently resilient to resist breakage or fracture when bent or compressed. Finally, the shear pin is preferably a steel, such as cold rolled steel, having a lower shear strength than the other materials from which the retention pin assembly is comprised.

There are alternative embodiments of the subject invention which may be devised within the scope and spirit of the description and following claims. It should be noted that when the same item or feature is shown in more than one embodiment, it will be labeled with the corresponding reference numeral to aid in the understanding of the subject invention. Furthermore, reference should be had to all of the Figures necessary to aid in the understanding of the specification even where a particular Figure is referred to, as all reference numerals are not displayed in all Figures in order to minimize confusion and aid in clarifying the subject invention.

In FIG. 5 is disclosed such an alternative embodiment of the retention pin 10-1. The retention pin 10-1 includes an alternative embodiment of the locking clip element 40-1. A locking clip bore 110-1 is provided from the locking clip groove 34 and extending through the pin main body 20-1 to the upper pin end 12-1. The alternative locking clip element 40-1 is curvilinear, as is the preferred embodiment. However, the locking clip element 40-1 includes a raised center section 42-1 which protrudes beyond the front pin face 22-1 and an upper end clip end 44-1 and a lower clip end 46-1 which are contained within the locking clip groove 30-1, which is a reversed wave form from that disclosed in the preferred embodiment. The locking clip element 40-1 includes a clip securing portion 112-1 which engages the locking clip bore 110-1 in an interference fit for securing the locking clip element 40-1 in the locking clip groove 30-1. The alternative retention pin 10-1 functions essentially identically with the preferred embodiment thereof in the described bucket tip sub-assembly, the raised center portion 42-1 performing the function of urging the retention pin 10-1 against the wall of the adapter nose bore 98.

It can be seen that the retention pin 10 according to the present invention provides several important advantages. The retention pin 10 is fairly inexpensive to manufacture, being of relatively straightforward and simple design, as well as easily replaced by field personnel for ease of maintenance in the bucket tip sub-assembly. Furthermore, the resilient nature of the locking clip element 40 in conjunction with the positioning shoulder 60 provides additional assurance that the retention pin will ensure the proper positioning of the bucket tip 70 on the bucket tip adapter 90, while permitting some resilience therebetween to reduce the likelihood of breakage of the bucket tip 70. Therefore, it can be seen that the present invention presents substantial improvements over the prior art.

Modifications to the preferred embodiment of the subject invention will be apparent to those skilled in the art within the scope of the claims that follow:

What is claimed is:

1. A retention pin (10) for retaining a bucket tip (70) to a bucket tip adapter (90) for an excavator bucket, said retention pin (10) comprised of:

a pin main body (20) having a pin front face (22) defining a locking clip groove (30) and a pin rear face (26) including a positioning shoulder (60) extending therefrom, said locking clip groove (30) being defined by a locking clip groove floor (34) and parallel, spaced-apart locking clip groove walls (32), said pin main body (22) further defining a transverse clip retaining pin bore (52); and a resilient locking clip element (40) disposed in said locking clip groove (30), said locking clip element (40) including a first locking portion (44) and a second locking portion (46).

2. The retention pin as set forth in claim 1 wherein said retention pin further includes a clip retaining pin disposed in said clip retaining pin bore transverse to said locking clip groove.

3. The retention pin as set forth in claim 2 wherein said locking clip element further includes a center clip portion in engagement with said clip retaining pin for retaining said locking clip element in said locking clip groove.

4. The retention pin as set forth in claim 3 wherein said pin front face further defines a shear pin bore.

5. The retention pin as set forth in claim 4 wherein said locking clip element is waveform shaped.

6. The retention pin as set forth in claim 5 wherein the waveform shape of said locking clip element is sinusoidal.

7. A bucket tip retention means comprised of:

a bucket tip (70) having a rearwardly extending first tab (77) with a first tab bore (80) defined therethrough and a spaced-apart second tab (76) with a second tab bore (82) defined therethrough, said first tab bore (80) co-axial with said second tab bore (82);

a bucket tip adapter (90) having an adapter nose (92) with an adapter nose bore (98) therethrough;

a retention pin (10) extending through said first tab bore (80), said adapter nose bore (98) and said second tab bore (82), said retention pin (10) including a pin main body (20) having a pin front face (22) defining a locking clip groove (30) and a pin rear face (26) including a positioning shoulder (60) extending therefrom, said locking clip groove (30) being defined by a locking clip groove floor (34) and parallel, spaced-apart locking clip groove walls (32), said pin main body (22) defining a transverse clip retaining pin bore (52), said retention pin further including a resilient locking clip element disposed in said locking clip groove (30), said locking clip element (40) including a first locking portion (44) and a second locking portion (46).

8. The retention pin as set forth in claim 7 wherein said retention pin further includes a clip retaining pin disposed in said clip retaining pin bore transverse to said locking clip groove.

9. The retention pin as set forth in claim 8 wherein said locking clip element further includes a center clip portion in engagement with said clip retaining pin for retaining said locking clip element in said locking clip groove.

10. The retention pin as set forth in claim 9 wherein said pin front face further defines a shear pin bore.

11. The bucket tip retaining means as set forth in claim 10 wherein said first tab further defines a tab shear pin bore.

12. The bucket tip retaining means as set forth in claim 11 wherein said bucket tip retaining means further includes a shear pin.

13. The retention pin as set forth in claim 10 wherein said locking clip element is waveform shaped.

14. The retention pin as set forth in claim 13 wherein the waveform shape of said locking clip element is sinusoidal.

15. A bucket tip retention means comprised of:

a bucket tip having a rearwardly extending first tab with a first tab bore defined therethrough and a spaced-apart second tab with a second tab bore defined therethrough, said first tab bore co-axial with said second tab bore;

a bucket tip adapter having an adapter nose with an adapter nose bore therethrough;

a retention pin extending through said first tab bore, said adapter nose bore and said second tab bore, said retention pin including a pin main body having a pin front face including a locking clip groove floor and parallel, spaced-apart locking clip groove walls defining a locking clip groove;

a transverse clip retaining pin bore having a clip retaining pin disposed therein;

a pin rear face including a positioning shoulder extending therefrom;

a resilient, waveform-shaped locking clip element disposed in said locking clip groove, said locking clip element including a first locking portion and a second locking portion and a center clip portion in engagement with said clip retaining pin for retaining said locking clip element in said locking clip groove.

16. The retention pin as set forth in claim 15 wherein said pin front face further defines a shear pin bore.

17. The bucket tip retaining means as set forth in claim 16 wherein said first tab further defines a tab shear pin bore.

18. The bucket tip retaining means as set forth in claim 17 wherein said bucket tip retaining means further includes a shear pin.

19. The retention pin as set forth in claim 18 wherein said locking clip element is waveform shaped.

20. The retention pin as set forth in claim 19 wherein the waveform shape of said locking clip element is sinusoidal.

21. A retention pin for retaining a bucket tip to a bucket tip adapter for an excavator bucket, said retention pin comprised of:

a pin main body having a pin front face including a defining a locking clip groove, a pin rear face including a positioning shoulder extending therefrom, and a locking clip securing bore extending from said locking clip groove to an upper pin end through said pin main body; and a resilient locking clip element disposed in said locking clip groove, said locking clip element including a first locking portion and a locking clip element securing portion disposed in said locking clip securing bore.

22. The retention pin as set forth in claim 21 wherein said locking clip element is waveform shaped.

23. The retention pin as set forth in claim 19 wherein the waveform shape of said locking clip element is sinusoidal.

* * * * *